US010001039B2

(12) United States Patent
Shin

(10) Patent No.: US 10,001,039 B2
(45) Date of Patent: Jun. 19, 2018

(54) DRAIN BOLT CONFIGURED TO BE FORCIBLY WITHDRAWN

(71) Applicant: Hyundal Shin, Hanam-si (KR)

(72) Inventor: Hyundal Shin, Hanam-si (KR)

( * ) Notice: Subject to any disclaimer, the term of this patent is extended or adjusted under 35 U.S.C. 154(b) by 164 days.

(21) Appl. No.: 15/232,294

(22) Filed: Aug. 9, 2016

(65) Prior Publication Data

US 2018/0045092 A1 Feb. 15, 2018

(51) Int. Cl.
*F16C 3/14* (2006.01)
*F16N 33/00* (2006.01)
*F01M 11/04* (2006.01)

(52) U.S. Cl.
CPC . *F01M 11/0408* (2013.01); *F01M 2011/0416* (2013.01)

(58) Field of Classification Search
CPC ..... F01M 11/0408; F01M 2011/0416; F01M 2011/0425; F01M 11/0004; F16H 57/0452
USPC ..... 184/1.5
See application file for complete search history.

(56) References Cited

U.S. PATENT DOCUMENTS 3,625,310 A * 12/1971 Herrick ..... F16H 57/0447 57/447
3,797,442 A * 3/1974 McRae ..... B63B 13/02 114/197
3,811,650 A * 5/1974 Dehar ..... F01P 11/02 184/1.5
3,869,391 A * 3/1975 Kramer ..... F15B 21/041 137/351
3,910,550 A * 10/1975 Nelson ..... F01P 11/0276 184/1.5
RE28,844 E * 6/1976 Dehar ..... F01P 11/02 184/1.5
4,361,310 A * 11/1982 Cummins ..... F16K 51/00 137/351
4,503,934 A * 3/1985 Stephanus ..... F01M 11/0408 138/89
4,745,894 A * 5/1988 Laipply ..... F01M 11/0408 123/196 R
4,807,847 A * 2/1989 Martz ..... F16K 1/38 137/327
4,951,783 A * 8/1990 Kamprath ..... F01M 11/0004 123/195 C
5,107,808 A * 4/1992 Mahn ..... F01M 11/0408 123/195 C (Continued)

*Primary Examiner* — Henry Y Liu
(74) *Attorney, Agent, or Firm* — John K. Park; Park Law Firm

(57) ABSTRACT

A drain bolt configured to be forcibly withdrawn from an oil tank. The drain bolt includes a fastening screw section integrally formed on one side of a head and an elastic screw section coupled to the distal end of the fastening screw section. The elastic screw section formed of a soft material has extension threads continuous to threads of the fastening screw section. The color of the elastic screw section is distinguishable from the color of the fastening screw section. The elastic screw section can be separated from a female thread portion of the oil tank due to force applied by a user or a mechanic. Even when the fastening screw section is separated from the female thread portion of the oil tank, the sealing ability between the drain bolt and the female thread portion is maintained due to the elastic screw section remaining in the meshed position.

6 Claims, 8 Drawing Sheets

(56) References Cited

U.S. PATENT DOCUMENTS 5,127,276 A * 7/1992 Prentiss ..... F01M 11/0408 141/321
5,176,215 A * 1/1993 Ackerman ..... F01M 11/0408 184/1.5
5,188,495 A * 2/1993 Jones, Jr. ..... F16B 43/001 285/220
5,420,557 A * 5/1995 Chern ..... B03C 1/286 184/6.25
5,547,042 A * 8/1996 Platt ..... F01M 11/0408 138/89
6,443,427 B2 * 9/2002 Coupal ..... F16K 31/504 184/1.5
6,837,479 B2 * 1/2005 Symonds, Jr. ..... F01M 11/0408 141/351
6,863,156 B2 * 3/2005 Seemann ..... F16H 57/0408 141/65
6,866,122 B2 * 3/2005 Brozovic ..... F01M 11/0408 184/1.5
7,357,225 B2 * 4/2008 Dorian ..... F01M 11/0408 123/196 R
8,186,921 B2 * 5/2012 Lowman ..... F01M 11/0408 184/1.5
8,281,896 B2 * 10/2012 Morgan ..... F01M 11/0408 184/1.5
8,418,812 B1 * 4/2013 Rosen ..... F01M 11/04 184/1.5
8,443,942 B2 * 5/2013 Franz ..... F16L 5/10 184/1.5
8,960,370 B2 * 2/2015 Langwald ..... F01M 11/0408 184/1.5
2004/0065376 A1 * 4/2004 Kristofferson ..... F01M 11/0408 138/89
2005/0072951 A1 * 4/2005 Alvarez ..... F16K 1/40 251/216
2006/0054402 A1 * 3/2006 Dorian ..... F01M 11/0408 184/1.5
2008/0135335 A1 * 6/2008 Lowman ..... F01M 11/0408 184/1.5
2008/0308351 A1 * 12/2008 Godek ..... F01M 11/0408 184/1.5
2009/0101440 A1 * 4/2009 Morgan ..... F01M 11/0408 184/1.5
2009/0283525 A1 * 11/2009 Martinez ..... F01M 11/0408 220/235
2010/0006376 A1 * 1/2010 Jessberger ..... F01M 11/0408 184/1.5
2010/0018589 A1 * 1/2010 Suzuki ..... F16H 57/0408 137/351
2010/0263745 A1 * 10/2010 Symes ..... F16K 15/183 137/528
2011/0011865 A1 * 1/2011 Cook ..... F01M 11/0004 220/288
2011/0197349 A1 * 8/2011 Lee ..... F01M 11/0408 4/295
2012/0318799 A1 * 12/2012 Spix ..... F16B 37/061 220/304
2013/0048115 A1 * 2/2013 Wise ..... F01M 11/0408 137/561 R
2013/0068778 A1 * 3/2013 Griffiths ..... F01M 11/0408 220/601
2014/0376680 A1 * 12/2014 Rao ..... F16K 17/383 376/347
2018/0010494 A1 * 1/2018 Cohen ..... F01M 11/0408

* cited by examiner

DRAIN BOLT CONFIGURED TO BE FORCIBLY WITHDRAWN

BACKGROUND OF THE INVENTION

Field of the Invention

The present invention relates to a drain bolt coupled to an oil tank of a vehicle or the like. More particularly, the present invention relates to a drain bolt configured to be forcibly withdrawn from an oil tank. The drain bolt has an elastic screw section coupled to a distal end of a fastening screw section, wherein the elastic screw section is formed of a soft material and has a color distinguishable from that of the fastening screw section, and threads of the fastening screw section and threads of the elastic screw section are formed to be continuous to each other to maintain the sealing ability of the drain bolt, whereby the drain bolt can be rapidly separated from an oil tank by unfastening the fastening screw section from the oil tank and then forcibly pulling the elastic screw section from the oil tank.

Description of the Related Art

In general, when surfaces of two metal members are rubbed against each other, frictional heat is generated. Frictional heat is a friction-induced loss of energy. In the case of a vehicle engine, friction reduces the output power of the engine and wears the engine, such that sintering occurs when heated to a high temperature.

Thus, in an engine generating power through relative movement of metal members, cooling and lubrication using engine oil is intended to remove sources of frictional heat and wear from the two metal surfaces that are rubbed against each other within the engine, thereby allowing the engine to smoothly operate and improving the endurance of the engine.

However, engine oil having such a use is subjected to degradation while being repeatedly circulated. The lubrication function of engine oil degrades as impurities are mixed with engine oil. Engine oil must be replaced with new oil after being used for a certain period of time in order to increase the longevity of an engine and improve the efficiency of the engine. Waste engine oil that has reached its lifespan is discharged from an oil tank in which engine oil is contained by separating a drain bolt fastened to a bottom outlet of the oil tank.

A conventional drain bolt is typically in the shape of a metal bolt. The drain bolt must be completely separated from the bottom outlet so that engine oil is discharged completely. However, it is difficult for a mechanic to visually recognize a precise point in time that the drain bolt is completely separated from the outlet and the mechanic must be positioned directly below the drain bolt to separate the drain bolt from the outlet. Thus, there is a danger that the mechanic's face or hand may be burned by hot waste oil pouring out at the moment that the drain bolt is separated.

Since a small amount of waste oil is discharged from the oil tank when the drain bolt is slightly separated from the outlet without being completely separated therefrom, even a skillful mechanic cannot avoid his or her hands or clothes coming into contact with waste engine oil. Further, it is highly possible that the drain bolt separated from the outlet may drop into a waste oil collecting tank and is contaminated by waste oil or lost, thereby making an oil exchange operation to be complicated. In addition, a portion of iron filings mixed with waste engine oil is not discharged from the oil tank and accumulates around the outlet in the bottom of an oil pan, thereby contaminating newly-supplied engine oil, which is problematic.

The information disclosed in the Background of the Invention section is only for the enhancement of understanding of the background of the invention, and should not be taken as an acknowledgment or as any form of suggestion that this information forms a prior art that would already be known to a person skilled in the art.

SUMMARY OF THE INVENTION

Accordingly, the present invention has been made keeping in mind the above problems occurring in the related art, and the present invention is intended to propose a drain bolt configured to be forcibly withdrawn from an oil tank and having an elastic screw section coupled to a distal end of a fastening screw section, wherein the elastic screw section is formed of a soft material and having a color distinguishable from that of the fastening screw section, threads of the fastening screw section and threads of the elastic screw section are formed to be continuous to each other, and the elastic screw section can be separated from a female thread portion of the oil tank due to force applied by a user or a mechanic.

Even in the case in which the fastening screw section is separated from the female thread portion of the oil tank in the process in which the drain bolt is unfastened and removed from the oil tank, the sealing ability between the drain bolt and the female thread portion is maintained due to the elastic screw section remaining in the meshed position. At the moment that the elastic screw section having a distinguishable color is exposed externally, the drain bolt is separated due to force applied by the user or the mechanic. Since the user or the mechanic can avoid contact with discharged oil, the safety of the user or the mechanic can be enhanced. In addition, contamination of the surroundings of the user or the mechanic can be minimized.

In order to achieve the above object, according to one aspect of the present invention, a drain bolt configured to be forcibly withdrawn may include: a fastening screw section integrally formed on one side of a head; and an elastic screw section coupled to the distal end of the fastening screw section. The elastic screw section has extension threads continuous to threads of the fastening screw section and is formed of a soft material. The color of the elastic screw section is distinguishable from the color of the fastening screw section.

According to the present invention, with the head and the fastening screw section, the drain bolt maintains the ability to close and open a drain outlet that conventional drain bolts have. It is possible to forcibly separate the overall drain bolt from an oil tank by pulling out the drain bolt by a predetermined length and then applying force to the drain bolt. In addition, it is possible to prevent a user or a mechanic from being burned and the surroundings of the user or the mechanic from being contaminated by oil that inevitably leaks out during the process of separating the drain bolt. Furthermore, it is possible to simply remove iron filings from the oil tank using the magnetic member disposed in the elastic screw section and prevent the drain bolt from being lost by attaching the drain bolt to a metal object after the drain bolt is separated from the oil tank. The decorative member coupled to the head can further improve the decorative characteristic of the drain bolt as well as the sense of unity of the drain bolt with respect to an object to which the drain bolt is fastened.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
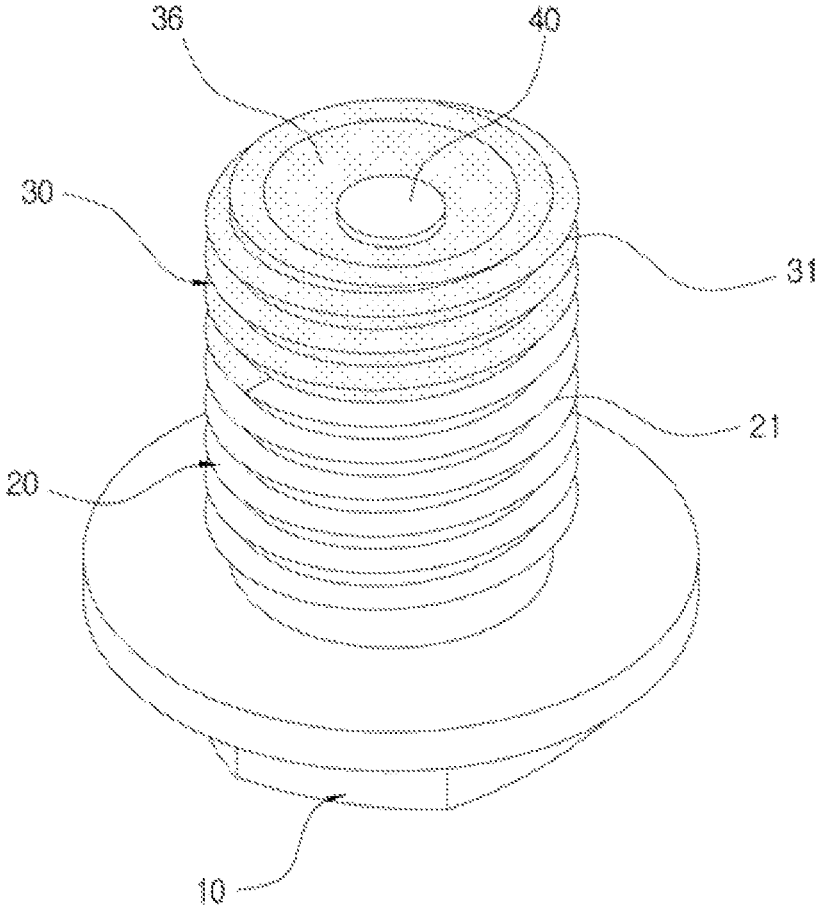
FIG. 1 is a top perspective view illustrating a drain bolt according to an exemplary embodiment of the invention.

Reference will now be made in greater detail to an exemplary embodiment of the present invention, an example of which is illustrated in the accompanying drawings. Wherever possible, the same reference numerals will be used throughout the drawings and the description to refer to the same or like parts.

Figure 2:
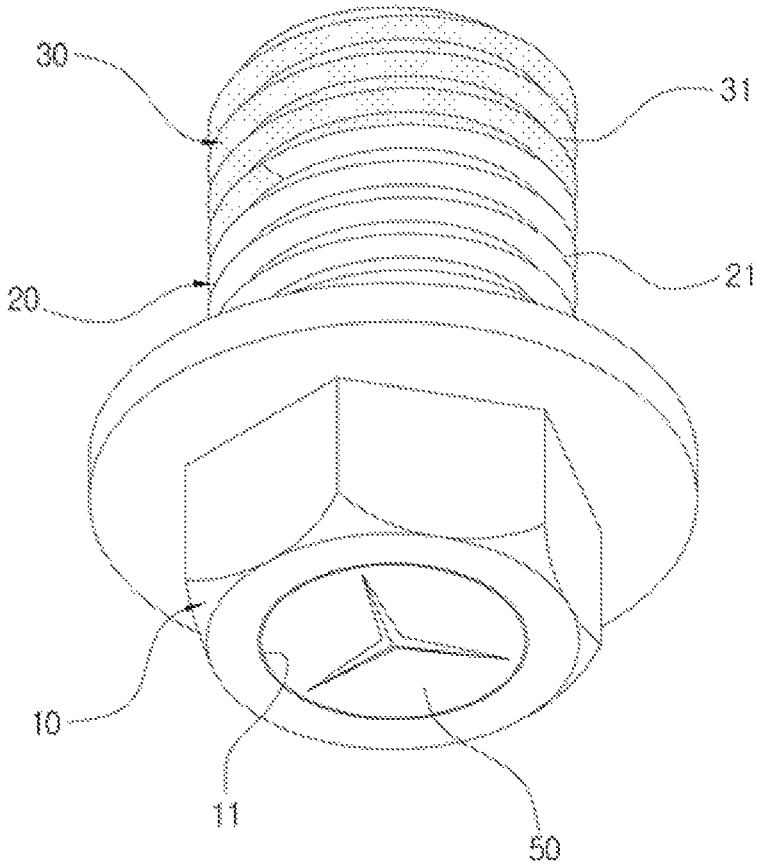
FIG. 2 is a bottom perspective view illustrating a drain bolt according to the exemplary embodiment of the invention.
Figure 3:
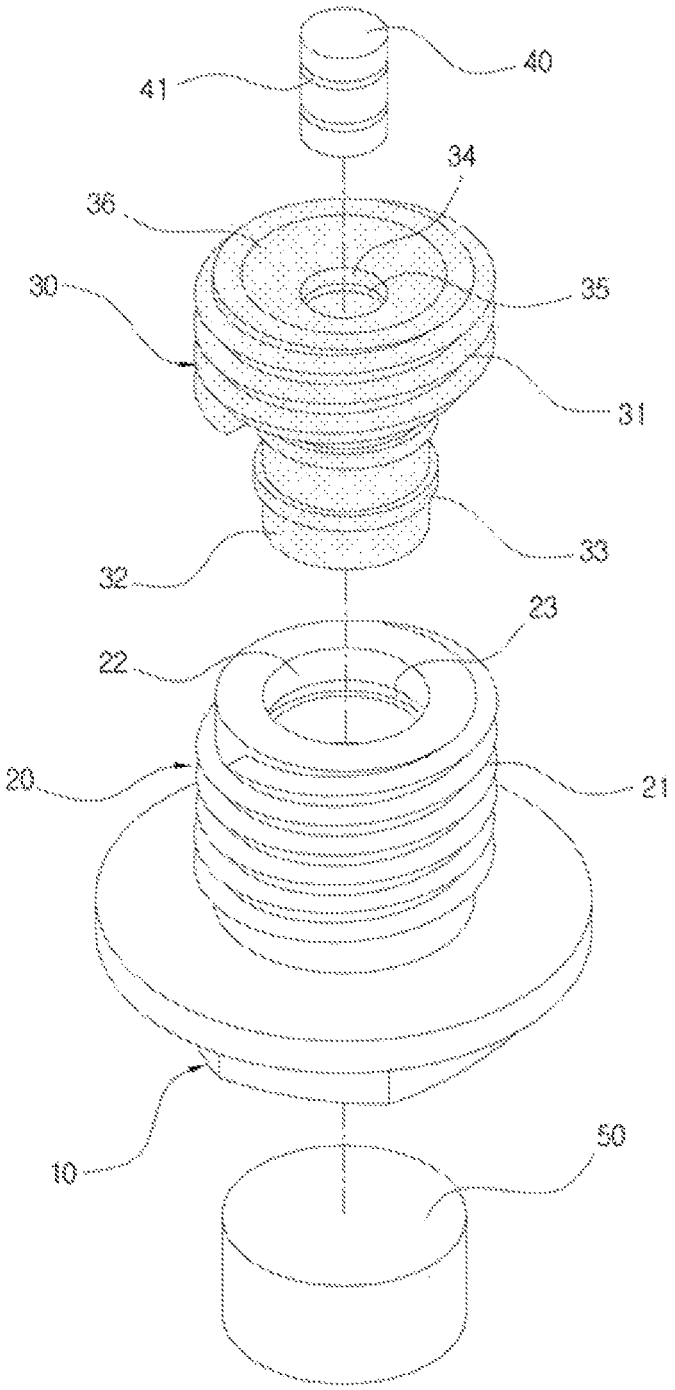
FIG. 3 is an exploded overall perspective view illustrating the drain bolt according to the exemplary embodiment of the invention.
Figure 4:
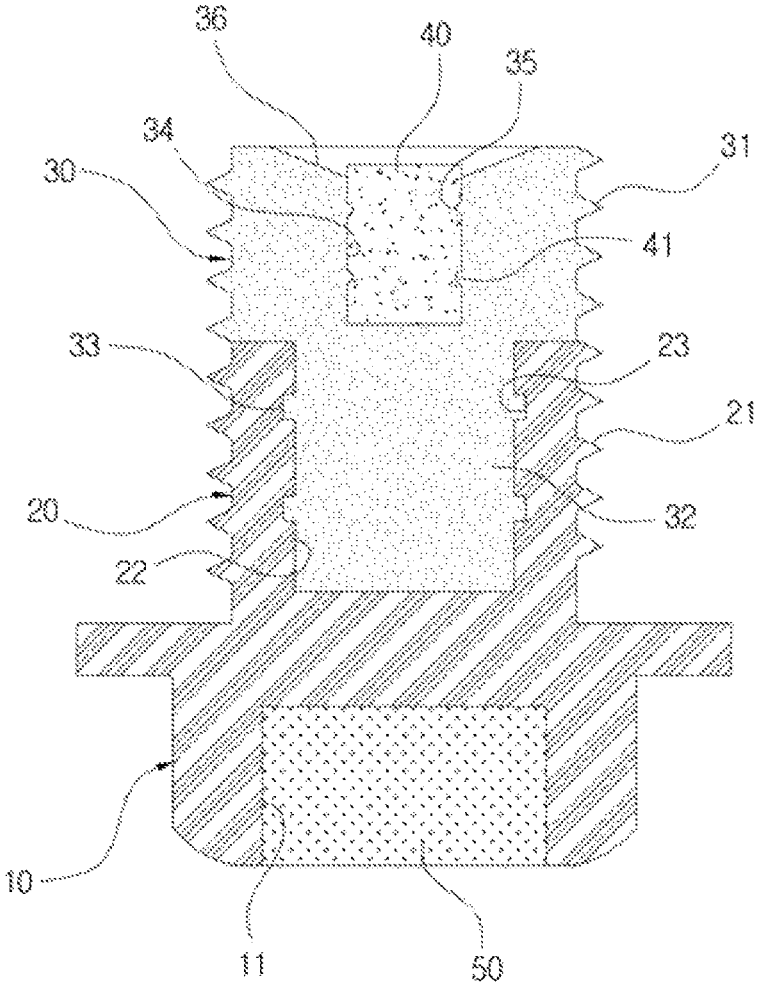
FIG. 4 is a cross-sectional view illustrating the drain bolt according to the exemplary embodiment of the invention.
Figure 5:
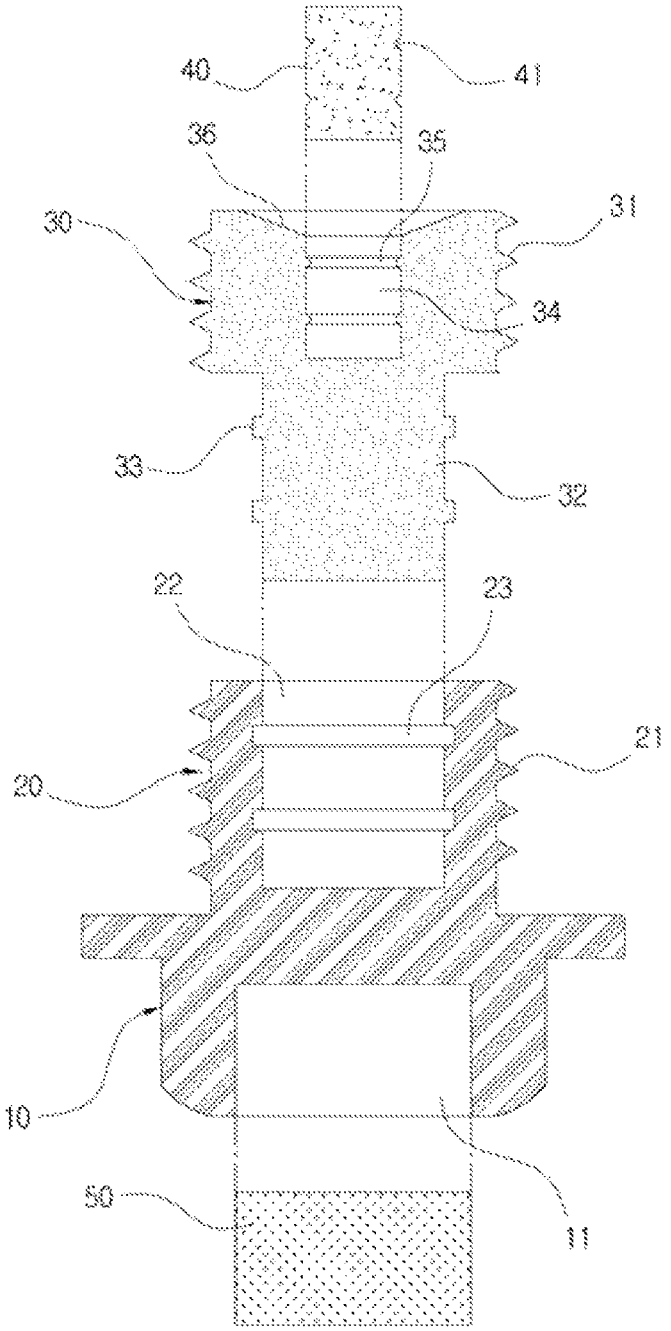
FIG. 5 is an exploded cross-sectional view illustrating the drain bolt according to the exemplary embodiment of the invention.

FIG. 1 is a top perspective view illustrating a drain bolt according to an exemplary embodiment of the invention, FIG. 2 is a bottom perspective view illustrating a drain bolt according to the exemplary embodiment of the invention, FIG. 3 is an exploded overall perspective view illustrating the drain bolt according to the exemplary embodiment of the invention, and FIG. 4 is a cross-sectional view illustrating the drain bolt according to the exemplary embodiment of the invention.

As illustrated in FIG. 1 to FIG. 4, the drain bolt according to the exemplary embodiment of the invention has a fastening screw section 20 disposed on one side of a head 10, the shape and thickness of which may vary, and an elastic screw section 30 coupled to the distal end of the fastening screw section 20. The elastic screw section 30 is formed of rubber, silicone, soft synthetic resin, or the like. The elastic screw section 30 may be formed by fixedly bonding or coupling the elastic screw section 30 to the fastening screw section 20 or through insert injection onto the fastening screw section 20.

Here, threads 21 of the fastening screw section 20 and extension threads 31 of the elastic screw section 30 are continuous to each other, and have the same thread size.

In addition, a decorative member 50 is separately formed of a light material. The decorative member 50 is coupled to the head 10. The elastic screw section 30 and the decorative member 50 serve to reduce the overall weight of a drain bolt.

In addition, the elastic screw section 30 has a color distinguishable from that of the fastening screw section 20. The color of the fastening screw section 20 and the color of the elastic screw section 30 are combined with different colors, whereby a user or a mechanic can rapidly recognize the presence of the elastic screw section 30.

A fastening groove 22 having a catch groove 23 is formed in the distal end of the fastening screw section 20, while a fitting portion 32 configured to be fitted into the fastening groove 22 is formed in one side of the elastic screw section 30. The fitting portion 32 has a catch projection 33 formed on the outer surface thereof to correspond to the catch groove 23. Due to strong fastening force between the catch groove 23 and the catch projection 33, the elastic screw section 30 can be firmly fixed to the distal end of the fastening screw section 20.

In particular, it may be ideal that the fastening groove 22 is formed as a quadrangular or hexagonal groove and the fitting portion 32 of the elastic screw section 30 is formed as a quadrangular or hexagonal column to realize a coupling structure able to prevent relative rotation between the fastening groove 22 and the fitting portion 32 when the fastening groove 22 and the fitting portion 32 are fastened to each other.

A magnetic member 40 is fixedly buried in the distal end surface of the elastic screw section 30 such that the distal end of the magnetic member 40 is exposed externally. The magnetic member 40 serves to attract iron filings mixed with oil or present on the bottom surface of an oil tank. The magnetic member 40 also allows the drain bolt to be temporarily attached to a surrounding metal object, thereby preventing the drain bolt to be lost.

A magnet recess 34 is formed in the distal end of the elastic screw section 30, allowing the magnetic member 40 to be interference-fitted thereinto. A fastening projection 35 is formed on the inner surface of the magnet groove 34, while a fastening groove 41 is formed in the outer surface of the magnetic member 40 to correspond to the fastening projection 35. Due to strong fastening and fixing force between the fastening projection 35 and the fastening groove 41, the magnetic member 40 can reliably remain in a position of being firmly fixed to the elastic screw section 30 without being separated therefrom.

In particular, the magnetic member 40 serves to attract and remove iron filings in oil or on the bottom of the oil tank, as described above. A trapping recess 36 is further formed in the distal end of the elastic screw section 30, such that iron filings remain as being attached to the inner portion of the trapping recess 36. The trapping recess 36 having this structure helps the magnetic member 40 firmly hold iron filings attached thereto. In addition, the trapping recess 36 makes it possible to reliably collect and remove more iron filings.

The trapping recess 36 may have a variety of shapes, such as a recess having an inclined cross-section or a recess having a curved cross-section.

In addition, the head 10 of the drain bolt has a concave decoration recess 11, and the decorative member 50 formed of a soft elastic material or a hard material, such as synthetic resin, is fixedly coupled to the decoration recess 11 by bonding or interference fitting. Since the decorative member 50 can be separately formed of a variety of materials and in a variety of colors, the decorative member 50 can improve the decorative characteristic of the drain bolt. When a vehicle brand or the like is expressed in the surface of the decorative member 50 by engraving or embossing, a brand image for the drain bolt can be imparted. Thus, the sense of unity with respect to an object to which the drain bolt is fastened can be provided.

Figure 6:
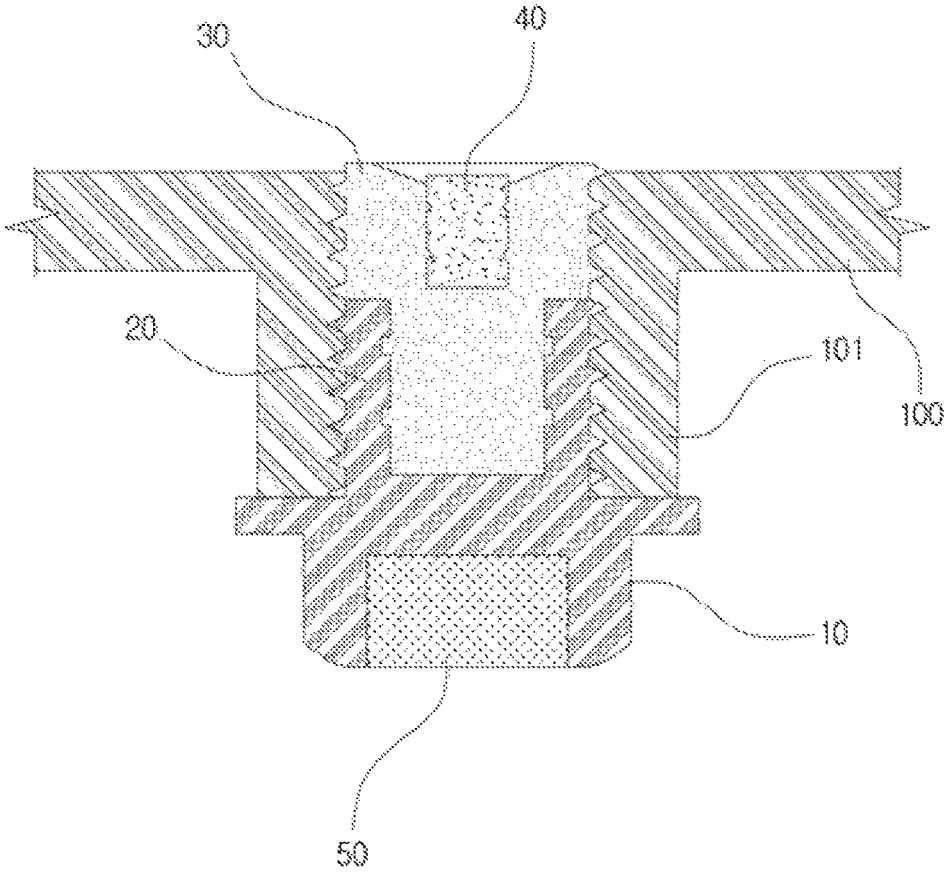
FIG. 6 is a cross-sectional view illustrating the fastened state of the drain bolt according to the exemplary embodiment of the invention.

As illustrated in FIG. 6, the drain bolt according to the invention as described above is fastened to a female thread portion 101 formed in a drain of an oil tank to prevent oil from leaking from the oil tank 100. Since both the fastening screw section 20 and the elastic screw section 30 are coupled to the female thread portion 101, the drain bolt can maintain superior sealing ability like conventional drain bolts. Since the elastic screw section 30 is formed of a soft material, the ability of the elastic screw section 30 to be in close contact with the female thread portion 101 is better than that of the fastening screw section 20, thereby improving sealing ability.

Figure 7:
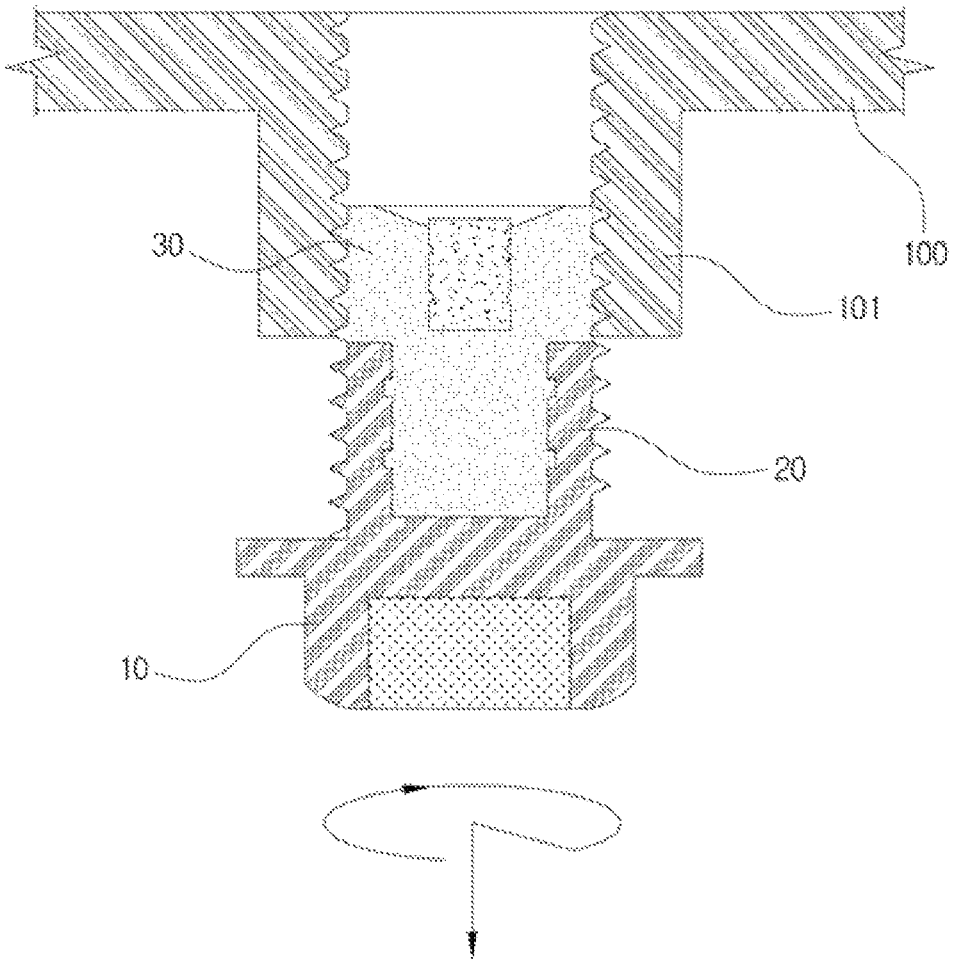
FIG. 7 is a cross-sectional view illustrating the process of separating the drain bolt according to the exemplary embodiment of the invention from an oil tank.
Figure 8:
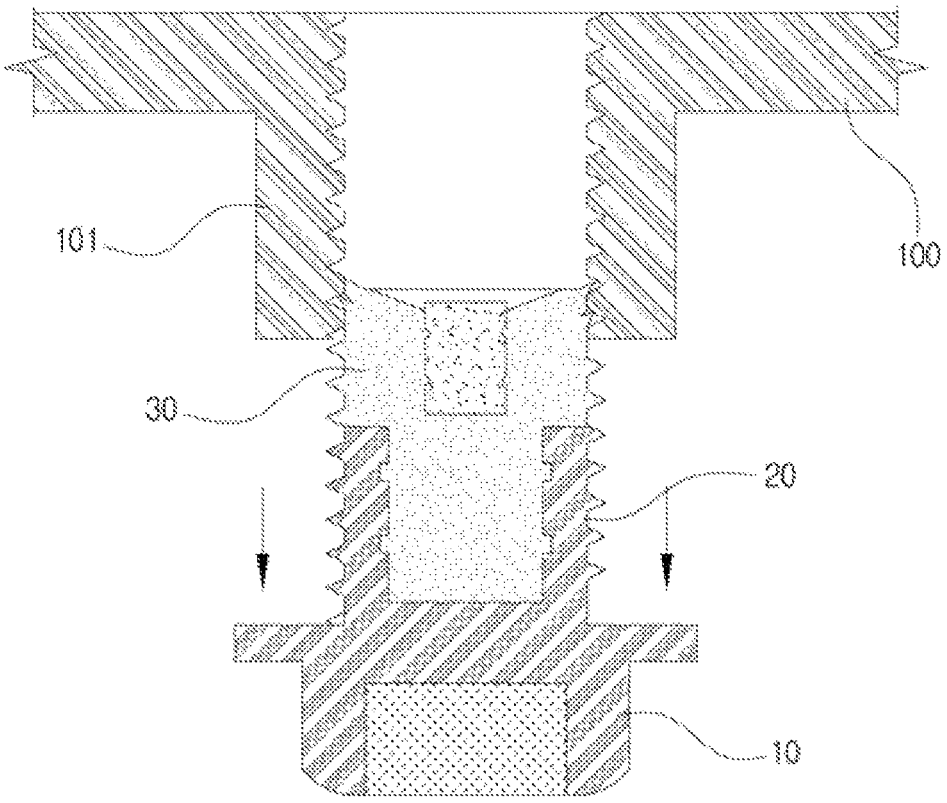
FIG. 8 is a cross-sectional view illustrating the state in which the drain bolt according to the exemplary embodiment of the invention is separated from the oil tank.

In the case of removing or exchanging oil in the oil tank 100 by unfastening the drain bolt coupled as described above, when the head 10 of the drain bolt is rotated using a work tool or the like, the screw coupling structure the fastening screw section 20 and the elastic screw section 30 move downwards while being unfastened from the female thread portion 101 due to the meshed structure. At the moment that the fastening screw section 20 is separated from the female thread portion 101, the elastic screw section 30 is visually exposed to the mechanic, as illustrated in FIG. 7.

At this time, the elastic screw section 30 still remains meshed with the female thread portion 101 while maintaining the sealing ability, such that oil does not leak. Since the elastic screw section 30 is visually recognized, the drain bolt according to the invention can be forcibly detached from the oil tank 100.

Thus, in the position in which the elastic screw section 30 is visually exposed to the outside, when the drain bolt is strongly pulled down, the extension threads 31 of the elastic screw section 30 are deformed due to the elasticity thereof to be separated from the female thread portion 101. It is thereby possible to rapidly separate the drain bolt from the female thread portion 101 all at once.

This can completely overcome the problem in that oil leaks due to the degradation or loss of sealing ability in the process in which the drain bolt is completely separated from the female thread portion. Since the drain bolt can be rapidly separated, it is possible to effectively prevent a user or a mechanic from being burned by hot oil or prevent the user, the mechanic, or a working place from being contaminated by leaking oil.

Although the exemplary embodiments of the present invention have been described for illustrative purposes, those skilled in the art will appreciate that various modifications, additions and substitutions are possible, without departing from the scope and spirit of the present invention as disclosed in the accompanying claims.

| Description of the Reference Numerals in the Drawings | |
|---|---|
| 10: head | 11: decoration recess |
| 20: fastening screw section | 21: threads |
| 22: fastening groove | 23: catch groove |

-continued

| Description of the Reference Numerals in the Drawings | |
|---|---|
| 30: elastic screw section | 31: extension threads |
| 32: fitting portion | 33: catch projection |
| 34: magnet recess | 35: fastening projection |
| 36: trapping recess | 40: magnetic member |
| 41: fastening groove | 50: decorative member |

What is claimed is:

1. A drain bolt configured to be forcibly withdrawn, comprising:

a fastening screw section integrally formed on one side of a head; and an elastic screw section coupled to a distal end of the fastening screw section, the elastic screw section having extension threads continuous to threads of the fastening screw section and being formed of a soft material, wherein a color of the elastic screw section is distinguishable from a color of the fastening screw section.

2. The drain bolt according to claim 1, wherein the fastening screw section has a fastening groove in a distal end thereof, and the elastic screw section has a fitting portion protruding from one side thereof, the fitting portion being able to be fixedly fitted into the fastening groove, wherein the fastening groove comprises a hexagonal groove and the fitting portion comprises a hexagonal column such that the fastening groove and the fitting portion are unable to rotate from each other when coupled to each other.

3. The drain bolt according to claim 2, wherein the fastening groove has a catch groove formed in an inner surface thereof, and the fitting portion has a catch projection formed on an outer surface thereof to correspond to the catch groove, such that the elastic screw section is fixedly coupled to the fastening screw section due to fastening force between the catch groove and the catch projection.

4. The drain bolt according to claim 1, further comprising a magnetic member fixedly fitted into a magnet recess formed in a distal end of the elastic screw section, wherein the magnet recess has a fastening projection on an inner surface thereof and the magnetic member has a fastening groove in an outer surface thereto to correspond to the fastening projection, such that the magnetic member is fixedly coupled to the elastic screw section due to fastening force between the fastening projection and the fastening groove.

5. The drain bolt according to claim 4, wherein the elastic screw section has a trapping recess in the distal end thereof.

6. The drain bolt according to claim 1, wherein the head has a decoration recess in an outer surface thereof, the drain bolt further comprising a light decorative member fitted into the decoration recess of the head.

* * * * *